US011357348B2

(12) United States Patent
DiLorenzo et al.

(10) Patent No.: US 11,357,348 B2
(45) Date of Patent: Jun. 14, 2022

(54) FOOTWEAR HANGER

(71) Applicant: TYR Sport, Inc., Farmingdale, NY (US)

(72) Inventors: Matthew Vito DiLorenzo, New York, NY (US); Sunki Jeon, Palisades Park, NY (US); Yang Wang, Syosset, NY (US); Jimmy Cai, New York, NY (US)

(73) Assignee: TYR Sport, Inc., Farmingdale, NY (US)

( * ) Notice: Subject to any disclaimer, the term of this patent is extended or adjusted under 35 U.S.C. 154(b) by 348 days.

(21) Appl. No.: 16/597,485

(22) Filed: Oct. 9, 2019

(65) Prior Publication Data

US 2021/0106159 A1 Apr. 15, 2021

(51) Int. Cl.
*A47G 25/00* (2006.01)
*A47F 7/08* (2006.01)

(52) U.S. Cl.
CPC ..... *A47G 25/005* (2013.01); *A47F 7/08* (2013.01)

(58) Field of Classification Search
CPC .. A47G 25/005; A47G 25/14; A47G 25/0685; A47G 25/485; A47G 25/28; A47G 25/30; A47G 25/48; A47G 25/483; A47F 7/08; A47L 23/20; E05B 69/003
USPC ..... 211/34; 223/85, 88, 91, 93, DIG. 1, 223/DIG. 2
See application file for complete search history.

(56) References Cited

U.S. PATENT DOCUMENTS 1,766,275 A * 6/1930 Werdon ..... A47G 25/28 223/88
1,885,503 A * 11/1932 Acton ..... A47G 25/485 223/93
2,321,700 A * 6/1943 Emile ..... A47G 25/483 223/69
2,573,622 A * 10/1951 Stoneburner ..... A47G 25/485 223/96

(Continued)

FOREIGN PATENT DOCUMENTS

GB 2240036 A * 7/1991 ..... A47G 25/32

OTHER PUBLICATIONS www.alienfield.com; "S780 Shoe Hanger Black"; 2 pages.

(Continued)

*Primary Examiner* — Hiwot E Tefera
(74) *Attorney, Agent, or Firm* — Stetina Brunda Garred and Brucker

(57) ABSTRACT

A display hanger for hanging first and second footwear items on a hanger support includes a base having a first and second end portions, and a central portion between the first and second end portions. A first footwear engagement element is coupled to the base at the first end portion and is rotatable relative to the base about a first rotation axis. A second footwear engagement element is coupled to the base at the second end portion and is rotatable relative to the base about a second rotation axis separate from the first rotation axis. The first and second footwear engagement elements are engageable with respective first and second footwear items. A support body is coupled to the central portion of the base and is rotatable relative to the base about a central rotation axis, with the support body being configured to be selectively engageable with the hanger support.

1 Claim, 5 Drawing Sheets

(56) References Cited

U.S. PATENT DOCUMENTS

| | | | | |
|---|---|---|---|---|
| 3,102,668 | A * | 9/1963 | Milligan | A47G 25/628 223/95 |
| 3,344,966 | A * | 10/1967 | Schaefer | A47G 25/48 223/96 |
| 5,901,888 | A * | 5/1999 | Schneider | A47G 25/1457 223/89 |
| 9,949,586 | B2 * | 4/2018 | Bennett | A47G 25/743 |
| 2003/0218034 | A1 * | 11/2003 | White | A47F 7/24 223/88 |
| 2006/0097018 | A1 * | 5/2006 | Cresap | A47G 25/4023 223/94 |
| 2012/0138640 | A1 * | 6/2012 | Lin | A47G 25/40 223/85 |
| 2013/0264362 | A1 * | 10/2013 | Watanabe | A47G 25/4023 223/85 |
| 2015/0359369 | A1 * | 12/2015 | Bennett | A47G 25/743 223/85 |

OTHER PUBLICATIONS www.uline.com; "6 Ball Waterfall for Slatwall—16", Chrome"; 1 page.
www.nahanco.com; "Plastic Sandal Hangers—3⅞", Black—100 Count"; 3 pages.
www.globalsources.com; "Shoe Hanger Shoes Display Hanger Multipurpose Hanger For Shoes"; 3 pages.

* cited by examiner

FOOTWEAR HANGER

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to a display hanger for merchandise, and more specifically to a display hanger specifically configured and adapted for displaying multiple items of merchandise in different display orientations, which may allow for optimization of the available display space.

2. Description of the Related Art

Merchandise offered for sale in a store may be displayed on a display rack in a manner which allows potential customers to easily view the items for sale. Certain items, such as footwear, are often sold in pairs and thus, when displayed for viewing by potential customers, a pair of footwear may be displayed together. In many instances, a single hanger may be used to display a pair of footwear, such that both footwear items are engaged with, and hang from the same hanger.

Several factors may be considered when organizing the arrangement of merchandise for display. Chief among the factors may be the space available for the display. In some instances, the available display space may be more optimal for a wide display area with a limited depth, while in other cases, the available display space may be more optimal for a deeper display area and a limited width. In the case of a wide display area, it may be desirable to display a given pair of footwear in a side-by-side configuration to maximize the available width, while minimizing the depth occupied by each pair of footwear. However, in the case of a deeper display area, a side-by-side display configuration may not maximize the available space. Instead, a display configuration with the pair of footwear stacked in a front-and-back arrangement may be a more effective use of the space. In view of the aforementioned optimal display configurations, different hangers may be needed to hang the merchandize in the most optimal display configuration.

Accordingly, there is a need in the art for a display hanger that is transitional between several different display configurations to allow for optimization of available display space. Various aspects of the present disclosure address this particular need, as will be discussed in more detail below.

BRIEF SUMMARY

In accordance with one embodiment of the present disclosure, there is provided a display hanger for hanging first and second footwear items on a hanger support. The display hanger includes a base having a first end portion, a second end portion and a central portion between the first and second end portions. A first footwear engagement element is coupled to the base at the first end portion and is rotatable relative to the base about a first rotation axis. The first footwear engagement element is configured to engage with the first footwear item. A second footwear engagement element is coupled to the base at the second end portion and is rotatable relative to the base about a second rotation axis separate from the first rotation axis. The second footwear engagement element is configured to engage with the second footwear item. A support body is coupled to the central portion of the base and is rotatable relative to the base about a central rotation axis, with the support body being configured to be selectively engageable with the hanger support.

The base may include a first opening at the first end portion, a second opening at the second end portion, and a central opening at the central portion. The first rotation axis may extend through the first opening, the second rotation axis may extend through the second opening, and the central rotation axis may extend through the central opening. The first footwear engagement element and the second footwear engagement element may each include a c-shaped clip body and a projection extending from the c-shaped clip body and insertable through a respective one of the first and second openings. The support body may include a plate and a projection extending from the plate and insertable through the central opening.

The first footwear engagement element, the second footwear engagement element, and the support body may each be independently rotatable relative to the base. The first footwear engagement element, the second footwear engagement element, and the support body may each be independently rotatable relative to the base by at least 90 degrees, by 180 degrees, or by 360 degrees.

The first and second footwear engagement element extend from the base in a first direction, and the support body extends from the base in a second direction opposite to the first direction.

According to another embodiment, there is provided a display device for displaying merchandise for sale on a display stand. The display device includes a support body configured to be rotatably engageable with the display stand. A first merchandise engagement element is rotatably coupled to the support body and is configured to be engageable with a first merchandise item for supporting the first merchandise item. A second merchandise engagement element is rotatably coupled to the support body in spaced relation to the first merchandise engagement element, with the second merchandise engagement element being configured to be engageable with a second merchandise item for supporting the second merchandise item.

According to another embodiment, there is provided a display hanger for displaying merchandise. The display device includes a base having a first end portion, a second end portion, and a central portion positioned between the first end portion and the second end portion. An upper surface extends across the first end portion, the second end portion and the central portion. A first opening extends through the base from the upper surface at the first end portion, with the first opening defining a first rotation axis. A second opening extends through the base from the upper surface at the second end portion, with the second opening defining a second rotation axis. A central opening extends through the base from the upper surface at the central portion, with the central opening defining a central rotation axis. A first set of rotation stops are positioned radially outward relative to the first rotation axis, and a second set of rotation stops are positioned radially outward relative to the second rotation axis. A first merchandise engagement element is received within the first opening and is rotatably coupled to the base. The first merchandise engagement element is configured to be engageable with a first merchandise item for supporting the first merchandise item. The first merchandise engagement element includes at least one locking member selectively engageable with a first one of the first set of rotation stops to allow the first merchandise element to assume a first configuration, and a second one of the first set of rotation stops to allow the first merchandise element to assume a second configuration. A second merchandise engagement element is received within the second opening and is rotatably coupled to the base. The second merchandise engagement element is configured to be engageable with a second merchandise item for supporting the second merchandise item. The second merchandise engagement element includes at least one locking member selectively engageable with a first one of the second set of rotation stops to allow the second merchandise element to assume a first configuration, and a second one of the second set of rotation stops to allow the second merchandise element to assume a second configuration.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
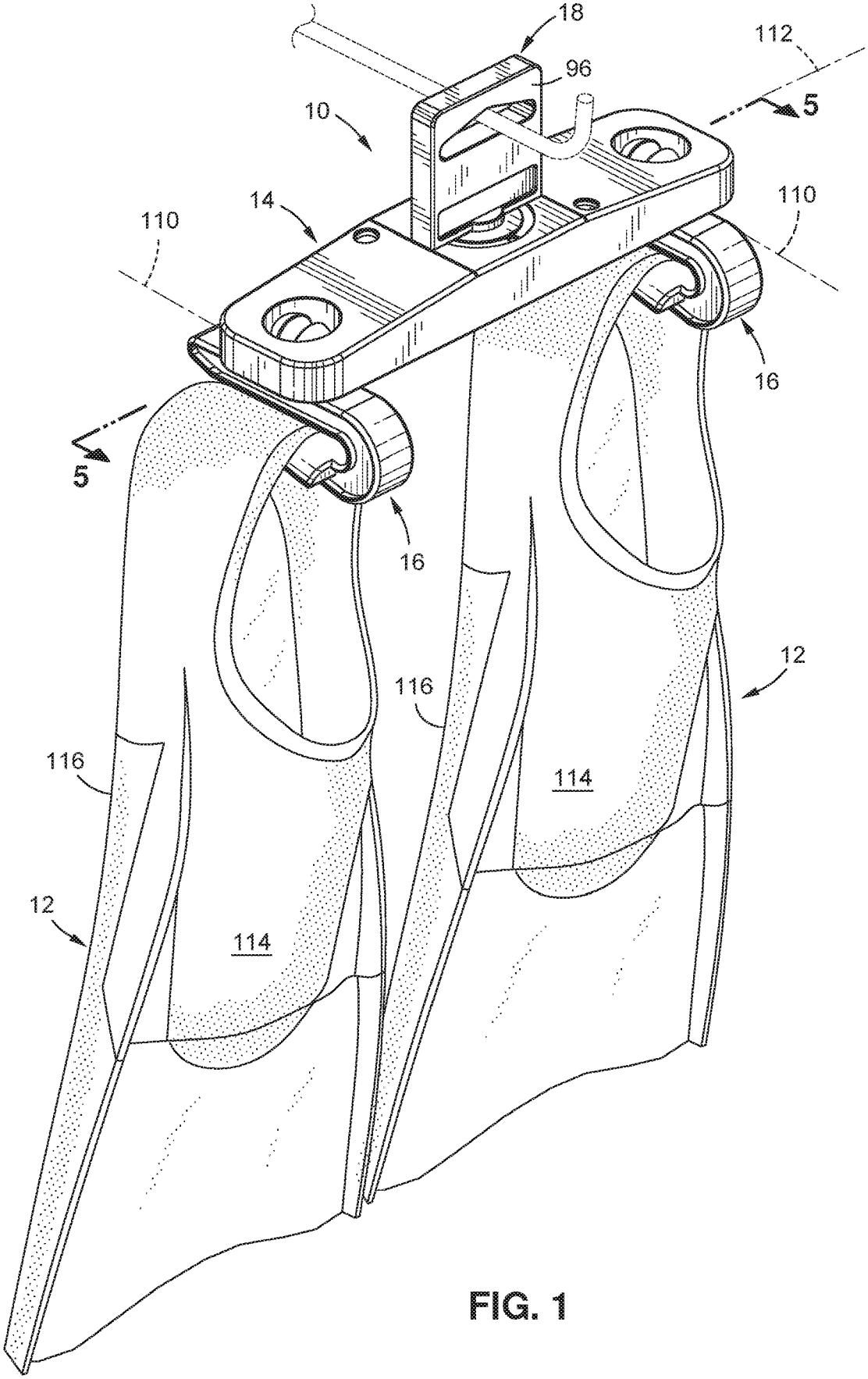
FIG. 1 is an upper perspective view of a display hanger displaying a pair of swim fins in a side-by-side configuration.

Referring now to the drawings wherein the showings are for purposes of illustrating a preferred embodiment of the present disclosure, there is depicted a display hanger 10 for displaying footwear such as swim fins 12 or other merchandise on a display rack. In particular, the display hanger 10 may be specifically configured and adapted to display the footwear/swim fins 12 in multiple arrangements. For instance, the display hanger 10 may allow the swim fins 12 to be displayed in a side-by-side arrangement (see FIG. 1) or a front-and-back arrangement (see FIG. 2). Thus, a user may select the arrangement based on the available space, with the side-by-side arrangement being more desirable when a wide display space is available, and a front-and-back arrangement being desirable when a deep display space is available. Thus, a retailer may use the display hanger 10 in many different display areas, rather than using one set of hangers for wide display areas and another set of hangers for deep display areas.

According to one embodiment, the display hanger 10 generally includes a base 14, a pair of clips 16, and a hang tab 18. As will be described in more detail below, the hang tab 18 and each of the clips 16 are rotationally coupled to the base 14 to allow the display hanger 10 to transition between the side-by-side configuration and the front-and-back configuration.

The base 14 may be generally quadrangular in shape and include a first end portion 20, a second end portion 22, and a central portion 24 positioned between the first and second end portions 20, 22. The base 14 may additionally include an upper surface 26, a pair of opposed primary sidewalls 28 and a pair of opposed secondary sidewalls 30, with each secondary sidewall 30 extending between the pair of primary sidewalls 28. The intersection between the primary sidewalls 28 and the secondary sidewalls 30 may define rounded corners. The upper surface 26 may be divided into multiple regions, including a central region extending along the central portion 24, a first end region extending along a first end portion 20, and a second end region extending along a second end portion 22. The first and second end regions may be slightly angled relative to the central region, which may result in a variable thickness of the base 14. More specifically, the base 14 may include a lower edge 32 opposite the upper surface 26 with the distance between the lower edge 32 and the upper surface 26 defining a base thickness. The base thickness may be larger at the at the central portion 24 and smaller at the terminal ends of the first and second end portions 20, 22. The base 14 may include ridges, depressions, or other physical demarcations on the upper surface 26 which separates the central portion 24 from the first and second end portions 20, 22.

Figure 5:
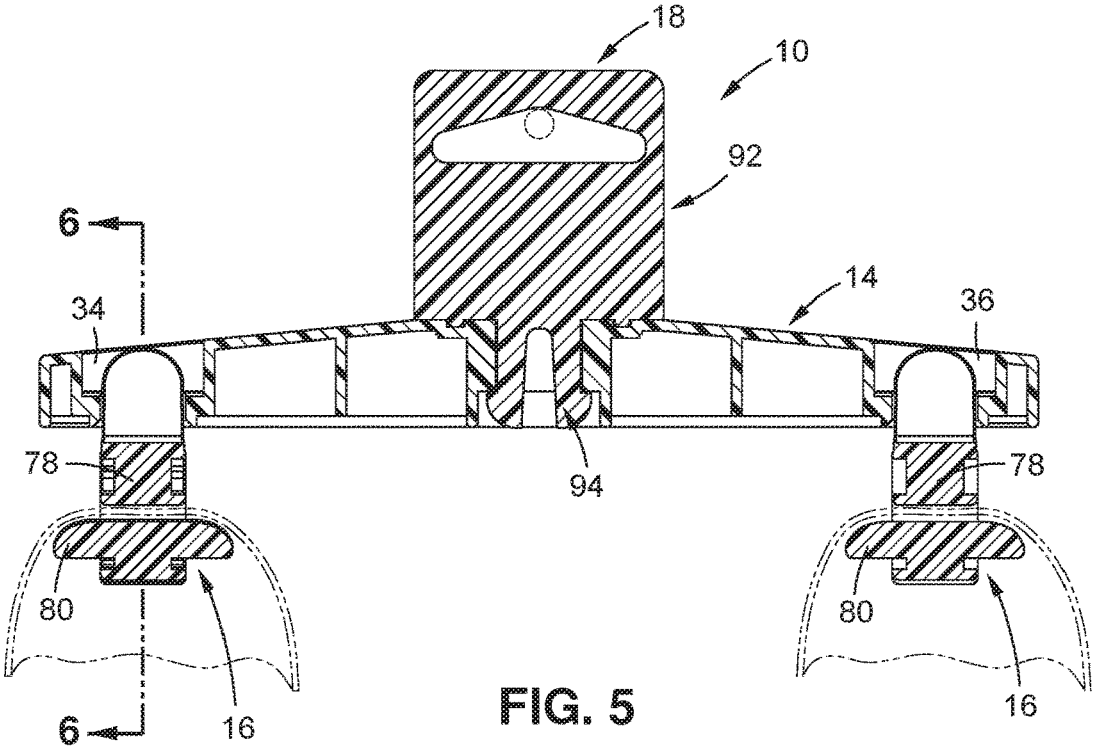
FIG. 5 is a front cross sectional view of the display hanger depicted in FIG. 1.
Figure 6:
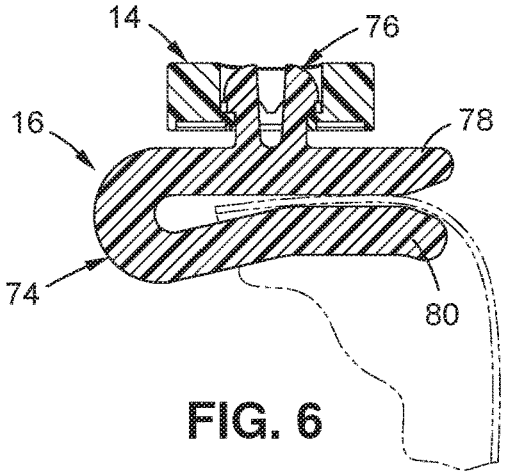
FIG. 6 is a cross sectional view of clip used in the display hanger.
Figure 7:
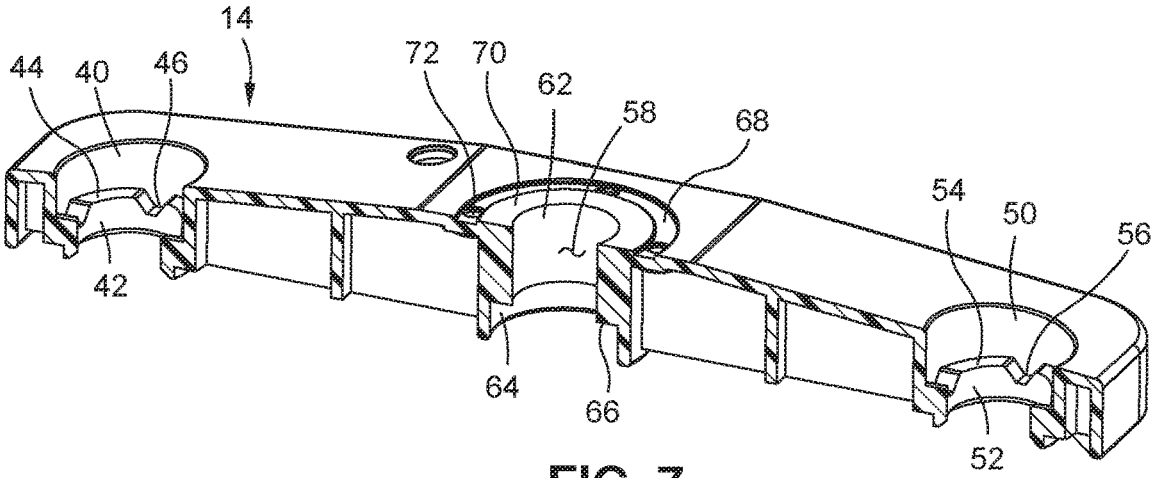
FIG. 7 is an upper perspective cross sectional view of a base used in the display hanger.

The base 14 may include multiple openings formed therein to facilitate engagement with the clips 16 and the hang tab 18. In particular, the base 14 may include a first opening 34 at the first end portion 20, a second opening 36 at the second end portion, and a central opening 58 at the central portion. The first opening 34 may extend about a first rotation axis 38 from the upper surface 26 completely through the base 14. As is best depicted in FIGS. 5 and 7, the first opening 34 may include a wide upper portion defined by an upper sidewall 40 and a narrow lower portion defined by a lower sidewall 42. A shoulder 44 may extend radially outward between the narrow sidewall 42 and the upper sidewall 40. The shoulder 44 may include a series of grooves 46 (e.g., rotation stops) extending radially outward from the narrow sidewall 42 to the upper sidewall 40, the purpose of which will be described in more detail below. Each groove 46 may include a first angled sidewall, a second angled sidewall, and a bottom wall extending between the first and second angled sidewalls. In one embodiment, the shoulder 44 may include four grooves 46 evenly spaced about the shoulder 44, i.e., every ninety degrees about the first rotation axis 38. However, the number of grooves 46 may vary without departing from the spirit and scope of the present disclosure.

The second opening 36 may be configured similar to the first opening 34 and extend about a second rotation axis 48 from the upper surface 26 completely through the base 14 and include a wide upper portion defined by an upper sidewall 50 and a narrow lower portion defined by a lower sidewall 52. A shoulder 54 may extend radially outward between the lower sidewall 52 and the upper sidewall 50. The shoulder 54 may include a series of grooves 56 (e.g., rotation stops) extending radially outward from the lower sidewall 52 to the upper sidewall 50. Each groove 56 may include a first angled sidewall, a second angled sidewall, and a bottom wall extending between the first and second angled sidewalls. In one embodiment, the shoulder 54 may include four grooves 56 evenly spaced about the shoulder 54, i.e., every ninety degrees about the second rotation axis 48. However, the number of grooves 56 may vary without departing from the spirit and scope of the present disclosure.

The central opening 58 may extend from the upper surface 26 through the base 14 about a central rotation axis 60. The central opening 58 may include a narrow upper portion defined by an upper wall 62 and a wide lower portion defined by a lower wall 64. A central shoulder 66 may extend between the upper wall 62 and the lower wall 64. On the upper surface 26, a circular groove 68 may extend around the central opening 58 (and the central rotation axis 60) in spaced relation to the central opening 58 to define a central ridge 70 therebetween. The circular groove 68 may extend from the upper surface 26 and terminate at a lower surface that is recessed from the upper surface 26. A plurality of recesses 72 (e.g., rotation stops) may extend into the base 14 from the lower surface. In the exemplary embodiment, each recess 72 is generally circular, although the recesses 72 may be formed in other shapes without departing from the spirit and scope of the present disclosure.

Each clip 16 (e.g., a footwear engagement element or merchandise engagement element) may include a c-shaped clip body 74 and a projection 76 extending from the c-shaped clip body 74 and insertable through a respective one of the first and second openings 34, 36. The c-shaped clip body 74 may include an upper prong 78 and a lower prong 80 connected to each other to define a closed end, and separated from each other to define an open end opposite the closed end and a slot extending from the open end toward the closed end. The upper prong 78 and the lower prong 80 may include angled surfaces that converge toward each other from distal ends of the upper and lower prongs 78, 80 toward the slot. The clip 16 may additionally include a pair of support surfaces 82 extending on opposed sides of the lower prong 80.

The projection 76 may extend from a middle portion of the upper prong 78 (i.e., between the open end and the closed end) and include a proximal segment 84 and a distal segment 86, with the proximal segment 84 being positioned between the upper prong 78 and the distal segment 86. The distal segment 86 may be enlarged relative to the proximal segment 84, such that the distal segment 86 may define a maximum diameter that is greater than the maximum diameter of the proximal segment 84. The projection 76 may additionally include a channel 88 extending into the projection 76 through the distal segment 86 and at least partially into the proximal segment 84. The channel 88 may allow the two sides of the projection 76 on either side of the channel 88 to flex inwardly when being inserted into the first opening 34 or the second opening 36 when connecting the clip 16 to the base 14.

The clip 16 may additionally include at least one tooth 90 (e.g., locking member) formed on the projection 76. In the exemplary embodiment, each clip 16 includes a pair of opposed teeth 90, with each tooth 90 extending downwardly from the distal segment 86 and overlapping a portion of the proximal segment 84. The teeth 90 are configured to be received in the grooves 46, 56 formed in the base 14 to register the clip 16 relative to the base 14 in a desired position. In the exemplary embodiment, each clip 16 includes a pair of diametrically opposed teeth 90, which may engage with a corresponding diametrically opposed set of grooves 46, 56. Since the grooves 46, 56 associated with both the first and second openings 34, 36 are spaced 90 degrees apart from each other, the teeth 90 may lock into the grooves 46, 56 when the clip 16 is rotated every 90 degrees. Each clip 16 may rotate independently relative to the other clip 16 360 degrees relative to the base 14. The engagement of the teeth 90 with the grooves 46, 56 provides a measure of rotational resistance to maintain the orientation of the clip 16 relative to the base 14. However, when the c-shaped bodies 74 are pressed toward the base 14, the teeth 90 may become disengaged and unseated from the groove 46, 56 to allow for rotation of the clip 16 relative to the base 14. In this regard, the distal end of each tooth 90 may be spaced from the c-shaped body 74 to provide space to allow the c-shaped body 74 to move toward the base 14.

Although the exemplary embodiment shows grooves 46, 56 on the base 14 and teeth 90 on the clips 16, it is contemplated that a reverse configuration (e.g., grooves on the clips 16 and teeth or ridges on the base 14) may be used without departing from the spirit and scope of the present disclosure. Furthermore, other locking mechanisms, such as ball detents, etc., known in the art may also be used.

The hang tab 18 (e.g., support body) includes a plate 92 and a projection 94 extending from the plate 92 and insertable through the central opening 58. The plate 92 includes a pair of opposing primary walls 96 and a peripheral wall 98 extending between the pair of primary walls 96. An opening 100 extends through the plate 92 between the pair of primary walls 96. The opening 100 may be shaped like a triangle and include a bottom and an apex opposite the bottom. The projection 94 may extend from the plate 92 and include a proximal segment 102 and a distal segment 104, with the proximal segment 102 being positioned between the plate 92 and the distal segment 104. The distal segment 104 may be enlarged relative to the proximal segment 102, such that the distal segment 104 may define a maximum diameter that is greater than the maximum diameter of the proximal segment 102. The projection 94 may additionally include a channel 106 extending into the projection 94, through the distal segment 104 and at least partially into the proximal segment 102. The channel 106 may allow the two sides of the projection 94 on either side of the channel 106 to flex inwardly when being inserted into the central opening 58 when connecting the hang tab 18 to the base 14.

The hang tab 18 additionally includes a plurality of nubs 108 (e.g., locking member) or small protuberances extending from the peripheral wall 98 thereof. The nubs 108 may be configured to be received within the recesses formed in the circular groove. In this regard, the diametrical spacing and alignment of the recesses may correspond to the spacing of the nubs 108. When the nubs 108 are received within respective recesses, rotational movement of the hang tab 18 may be restricted. However, if sufficient force is applied, the nubs 108 may become unseated from the recesses to allow for rotation of the hang tab 18 relative to the base 14 about the central rotation axis 60.

Although the exemplary embodiment shows recesses on the base 14 and nubs 108 on the hang tab 18, it is contemplated that a reverse configuration (e.g., recesses on the hang tab 18 and nubs 108 on the base 14) may be used without departing from the spirit and scope of the present disclosure.

With the basic structure of the display hanger 10 described above, the following discussion pertains to an exemplary use of the display hanger 10. The display hanger 10 is assembled by inserting the projections 76 on the clips 16 through respective ones of the first and second openings 34, 36 formed in the base 14. In addition, the hang tab 18 is connected to the base 14 by inserting the projection 94 on the hang tab 18 through the central opening 58. When the display hanger 10 is assembled, the hang tab 18 and the clips 16 extend from the base 14 in opposite directions, e.g., the hang tab 18 is positioned above the base 14, while the clips 16 are positioned below the base 14.

Figure 2:
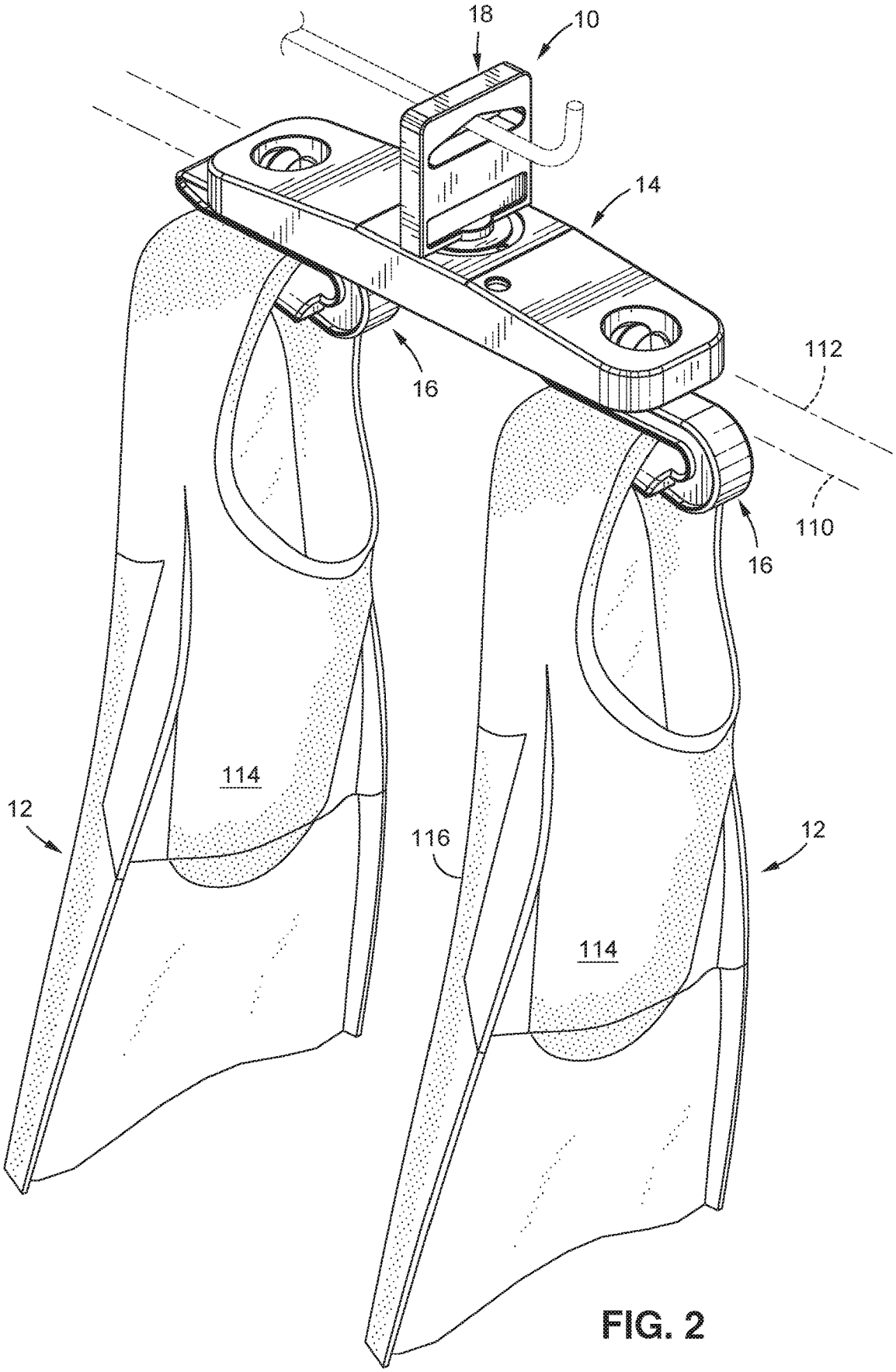
FIG. 2 is an upper perspective view of a display hanger displaying a pair of swim fins in a front-and-back configuration.
Figure 3:
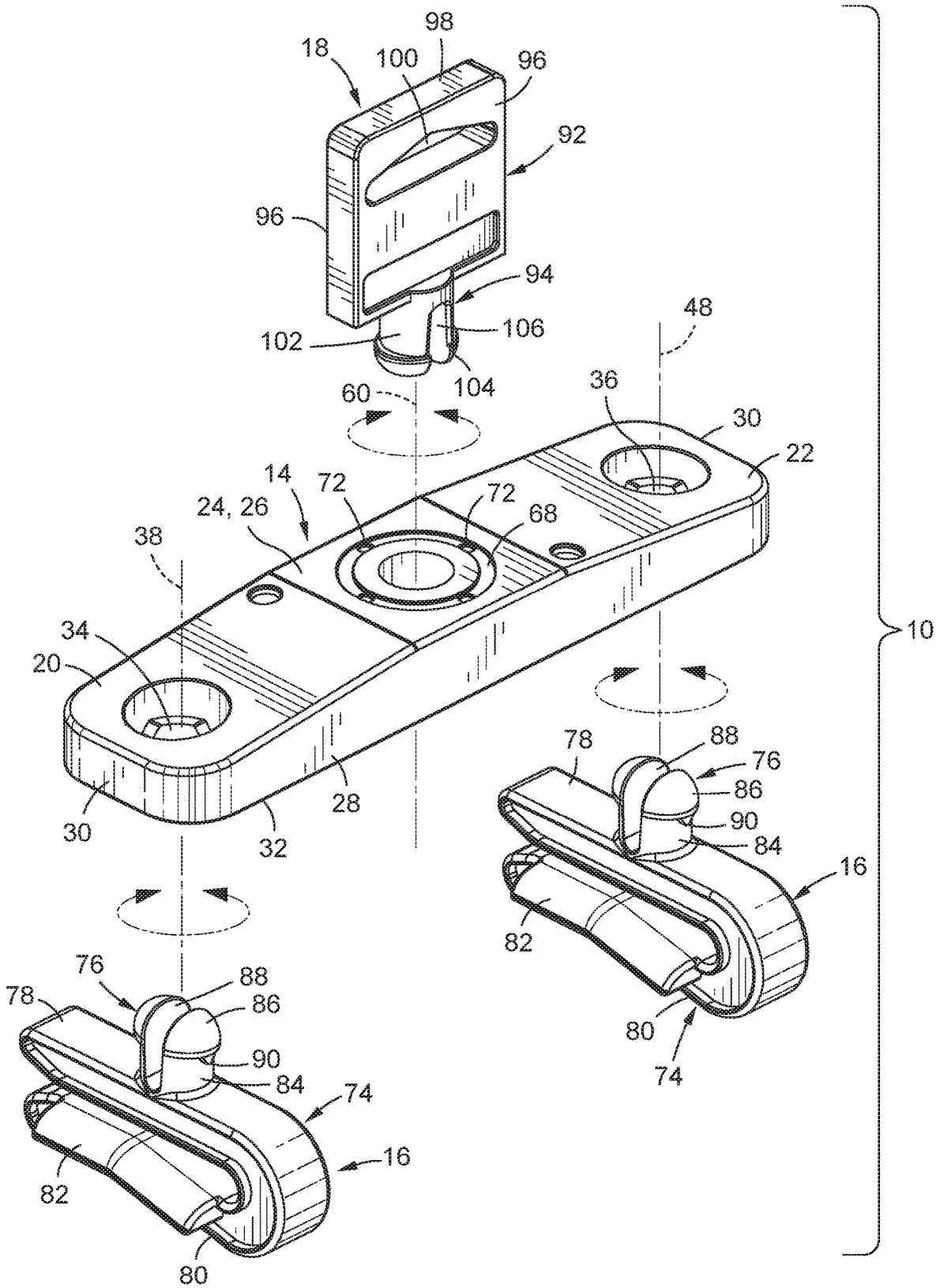
FIG. 3 is an exploded upper perspective view of the display hanger.
Figure 4:
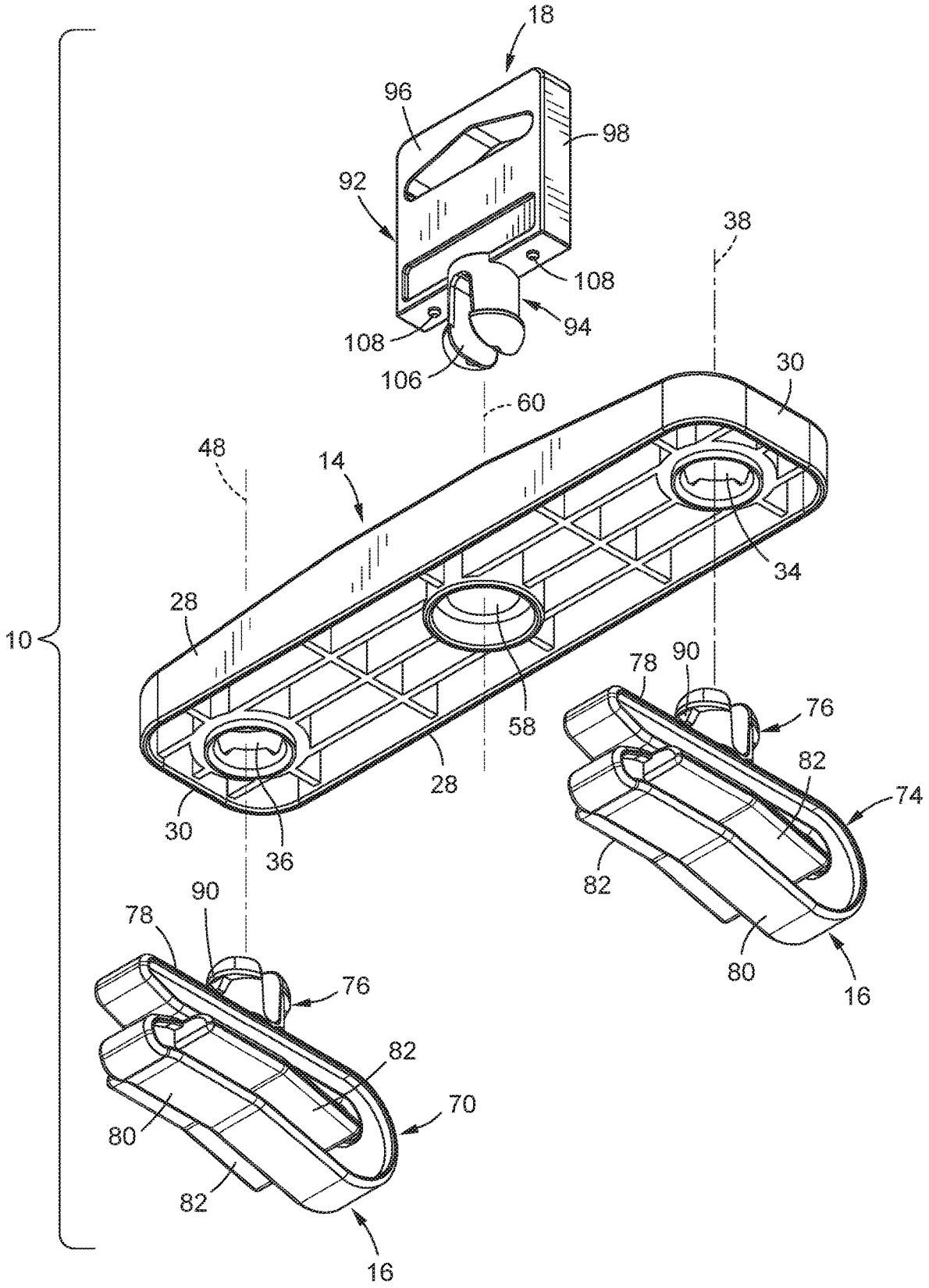
FIG. 4 is an exploded lower perspective view of the display hanger.

As shown in FIGS. 1 and 2, the display hanger 10 is used to display swim fins 12, which may be engaged with the clips 16 by inserting the heal portion of the swim fins 12 into the slot formed on the clips 16. The clips 16 and the hang tab 18 may be rotated relative to the base 14 to achieve the desired hanging configuration of the swim fins 12.

As shown in FIG. 1, the display hanger 10 is in a side-by-side configuration. In this regard, the longitudinal axes 110 of the clips 16 are generally transverse or perpendicular to the longitudinal axis 112 of the base 14. Furthermore, the clips 16 are positioned relative to the hang tab 18 such that the longitudinal axes 110 defined by the clips 16 are generally perpendicular to the primary walls 96 of the hang tab 18, with the longitudinal axes 110 extending on opposite sides of the hang tab 18. When the display hanger 10 is in the side-by-side configuration, the tops 114 of the swim fins 12 generally face the same direction and the bottoms 116 of the swim fins 12 generally face the same direction. Thus, when the display hanger 10 is hung from a rod when in the side-by-side configuration, the swim fins 12 are presented to the user in a side-by-side arrangement, which may be desirable when the display space is wide.

As shown in FIG. 2, the display hanger 10 is in a front-and-back configuration. In this regard, the longitudinal axes 110 of the clips 16 are generally co-axially aligned with each other and parallel to the longitudinal axis 112 of the base 14. Furthermore, the clips 16 are positioned relative to the hang tab 18 such that the longitudinal axes 110 defined by the clips 16 are generally perpendicular to the primary walls 96 of the hang tab 18 and extending within a plane that passes through the apex and divides the plate 92 in a symmetrical manner. When the display hanger 10 is in the front-and-back configuration, the top of one swim fin faces the bottom of the other swim fin. Thus, when the display hanger 10 is hung from a rod in the front-and-back configuration, the swim fins 12 are presented to the user in a stacked, one-in-front-of-the-other arrangement, which may be desirable in a narrow, but deep display space.

The display hanger 10 may be configured to facilitate selective transition between the side-by-side configuration and the front-and-back configuration simply via rotation of the clips 16 relative to the base 14 and the display tab relative to the base 14.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A display hanger for displaying merchandise, the display device comprising:

a base having:

a first end portion;

a second end portion;

a central portion positioned between the first end portion and the second end portion;

an upper surface extending across the first end portion, the second end portion and the central portion;

a first opening extending through the base from the upper surface at the first end portion, the first opening defining a first rotation axis;

a second opening extending through the base from the upper surface at the second end portion, the second opening defining a second rotation axis;

a central opening extending through the base from the upper surface at the central portion, the central opening defining a central rotation axis;

a first set of rotation stops positioned radially outward relative to the first rotation axis; and a second set of rotation stops positioned radially outward relative to the second rotation axis;

a first merchandise engagement element received within the first opening and rotatably coupled to the base and configured to be engageable with a first merchandise item for supporting the first merchandise item, the first merchandise engagement element including at least one locking member selectively engageable with a first one of the first set of rotation stops to allow the first merchandise element to assume a first configuration, and a second one of the first set of rotation stops to allow the first merchandise element to assume a second configuration; and a second merchandise engagement element received within the second opening and rotatably coupled to the base and configured to be engageable with a second merchandise item for supporting the second merchandise item, the second merchandise engagement element including at least one locking member selectively engageable with a first one of the second set of rotation stops to allow the second merchandise element to assume a first configuration, and a second one of the second set of rotation stops to allow the second merchandise element to assume a second configuration;

wherein the first merchandise engagement element and the second merchandise engagement element each include a c-shaped clip body and a projection extending from the c-shaped clip body and insertable through a respective one of the first and second openings.

* * * * *